US006814418B2

(12) United States Patent
D'Orso

(10) Patent No.: US 6,814,418 B2
(45) Date of Patent: Nov. 9, 2004

(54) LOCKER ORGANIZER

(76) Inventor: Ronald D'Orso, 31 Grove St., Kennebunk, ME (US) 04043

( * ) Notice: Subject to any disclaimer, the term of this patent is extended or adjusted under 35 U.S.C. 154(b) by 0 days.

(21) Appl. No.: 10/387,471

(22) Filed: Mar. 14, 2003

(65) Prior Publication Data

US 2004/0178706 A1 Sep. 16, 2004

(51) Int. Cl.[7] ..... A47B 88/00

(52) U.S. Cl. ..... 312/351; 312/6; 108/149; 211/118

(58) Field of Search ..... 312/3, 4, 5, 6, 312/257.1, 245, 107, 351; 108/149, 182, 27, 248; 211/118, 113

(56) References Cited

U.S. PATENT DOCUMENTS

| | | | | |
|---|---|---|---|---|
| 889,517 A | | 6/1908 | Gerken | |
| 1,847,066 A | | 3/1932 | Berg | |
| 2,299,021 A | | 10/1942 | Hoffman | |
| 2,556,105 A | * | 6/1951 | Smith | 108/106 |
| 2,997,217 A | * | 8/1961 | Levy | 223/92 |
| 3,184,273 A | | 5/1965 | Blough | |
| 4,067,454 A | * | 1/1978 | Helbling | 414/26 |
| 4,167,908 A | * | 9/1979 | Jones et al. | 108/182 |
| 4,244,301 A | * | 1/1981 | Nakatsu | 108/149 |
| 4,388,982 A | * | 6/1983 | Yonahara | 182/82 |
| 4,523,526 A | * | 6/1985 | O'Neill | 108/149 |
| 4,537,451 A | | 8/1985 | Bredderman et al. | |
| 4,818,044 A | | 4/1989 | Dobry | |
| 4,858,772 A | | 8/1989 | Phillipson | |
| 5,154,500 A | | 10/1992 | Chang | |
| 5,251,973 A | | 10/1993 | Hazan | |
| 5,474,192 A | | 12/1995 | Hartzell | |
| 5,542,530 A | | 8/1996 | Freelander | |
| 5,671,990 A | | 9/1997 | Teasdale | |
| 5,810,457 A | * | 9/1998 | Felsenthal et al. | 312/6 |
| 5,871,124 A | * | 2/1999 | Wilkinson | 222/192 |
| 5,950,844 A | * | 9/1999 | Taylor | 211/85.7 |

FOREIGN PATENT DOCUMENTS

| | | |
|---|---|---|
| EP | 385607 | 9/1990 |
| EP | 543063 | 5/1993 |
| FR | 2458246 | 1/1981 |
| GB | 623673 | 5/1949 |
| WO | 94/27474 | 12/1994 |

* cited by examiner

*Primary Examiner*—Peter M. Cuomo
*Assistant Examiner*—Stephen Vu
(74) *Attorney, Agent, or Firm*—Richard C. Litman

(57) ABSTRACT

A locker organizer includes one or more shelves which may be suspended from the conventional coat hooks of a wall locker or the like. The present locker organizer also includes a series of wedges adjustably extending from at least one edge of the shelf or shelves, allowing the shelf or shelves to be secured immovably between opposed walls of the locker. This precludes the banging of the shelves against the interior walls of the locker whenever the shelves are accessed, e.g., placement or removal of books and/or other articles thereon or therefrom. The shelf or shelves are adjustably suspended by suspension lines which may be formed of a stout cord, rope, or chain. The suspension lines may include index indicators to aid the user in adjusting the position of the shelf or shelves thereon, to assure that the shelf or shelves remain substantially level when installed in the locker.

16 Claims, 4 Drawing Sheets

LOCKER ORGANIZER

BACKGROUND OF THE INVENTION

1. Field of the Invention

The present invention relates generally to shelves and the like, and more specifically to a suspended shelf which may be hung from the conventional coat hooks provided in a conventional wall locker, as normally installed in gymnasium locker rooms in schools, health clubs, spas, sports arenas, employee dressing rooms, and, similar facilities. The present locker organizer invention may include a series of suspended shelves, including means for taking up lateral slack along the edges of the shelves to prevent lateral movement and noise against the interior sides of the locker.

2. Description of the Related Art

Lockers for schools and other facilities are conventionally constructed of relatively thin metal, and have a relatively narrow and tall configuration. While such a configuration conserves lateral space and provides convenience in hanging a very few articles of clothing within the locker, the storage of other articles (e.g., books, shoes, backpacks, etc.) is inconvenient at best, due to the relatively small floor area provided in such tall and narrow locker configurations. While others have also recognized this problem, past solutions have not provided all of the benefits of the present invention.

Most of the various locker shelves developed in the past have comprised rigid structures, requiring some time to assemble and install properly within the locker. Other devices have been developed which are easier to install within a locker, but those devices fail to provide the relatively wide and level shelf space of the present invention. Moreover, none of the shelves of the prior art have provided the positive fit of the present locker organizer invention within a locker, at least for suspended shelves.

Accordingly, a need will be seen for a locker organizer comprising one or more suspended shelves, providing ease of installation within a conventional gym locker or the like. The present locker organizer further includes means to facilitate the leveling of the shelves, and further means for positively locking the shelves within the locker so as to preclude lateral movement and noise due to the shelves banging against the interior walls of the locker.

A discussion of the related art of which the present inventor is aware, and its differences and distinctions from the present invention, is provided below.

U.S. Pat. No. 889,517 issued on Jun. 2, 1908 to Charles L. Gerken, titled "Rotary Display Stand," describes a stand having a rotating central column supported at top and bottom, with a series of radially disposed arms suspended at their distal ends by chains extending from the upper end of the central column. Shelves rest upon the radial arms. The Gerken stand teaches away from the present invention, as Gerken cannot use opposed lateral suspension members (as in the coat hooks conventionally provided in lockers) to support his stand, as such lateral support would preclude rotation. Moreover, the central column of the Gerken rotating stand interferes with the placement of relatively wide articles (e.g., schoolbooks, etc.) upon the shelves. The shelves of the present locker organizer are open across their entire spans and depths.

U.S. Pat. No. 1,847,066 issued on Mar. 1, 1932 to Mathilde C. Berg, titled "Collapsible Shoe Bag," describes a device comprising a series of rigid shelves suspended in a vertical tier by a series of flexible panels enclosing three of the four sides or edges of the shelves. The Berg shoe bag shelves are permanently affixed within the folding walls or side panels, unlike the present invention with the lateral enclosure being defined by the walls of the locker in which the device is installed. Moreover, Berg provides only a single suspension point, which is not suitable for use in a conventional wall locker with its typical opposed lateral coat hooks installed on opposite walls of the locker. Finally, Berg does not provide any means of adjusting the height of her shelves within the flexible walls of her device, nor does she provide any means of adjusting the width of the device to accommodate slack if installed within a wall locker or the like.

U.S. Pat. No. 2,299,021 issued on Oct. 13, 1942 to Herbert E. Hoffman, titled "Foldable And Suspendable Rack For Shoes Or The Like," describes a rack having a series of rigid crossmembers forming rectangles, and suspended by ropes or cords at their ends. Hoffman does not provide any form of solid, rigid shelving for each level of his device, and states that the longitudinal and lateral members must be pivotable relative to one another to provide for complete folding. Moreover, the Hoffman device is relatively small, with a span extending from a point beneath the instep to a point beneath the toe of a conventional shoe, or something on the order of six inches or so. This is much too small to span the interior of a wall locker or the like, as is necessary to provide sufficient storage for books and similar articles. Finally, Hoffman teaches that his supports are sloped from back to front, with the heels of the shoes being captured by the higher rearward crossmember of each level. Such sloped supports are not desirable for the storage of books, notebooks, and many other articles.

U.S. Pat. No. 3,184,273 issued on May 18, 1965 to Ronald S. Blough, titled "Shelf Bag Stabilizer," describes a link or arm which attaches between the upper peripheral frame of a shoe bag or the like, and the closet hanger rod from which the shoe bag is suspended. The Blough device is immovably affixed to the closet rod, and thus prevents the hanging bag from rotating relative to the rod when the bag or its contents are accessed. The shoe bag disclosed in the Blough patent contains a series of suspended rigid shelves therein, with ropes or cords suspending the shelves from the upper peripheral frame. However, a flexible enclosure bag extends around the shelves, unlike the present locker organizer. This structure teaches away from the present invention, as the flexible enclosure bag disclosed in the Blough patent would not permit the use of wedges or other means between the shelf edges and the bag for precluding movement of the shelves within the bag. In contrast, the present locker organizer includes means for immovably affixing the suspended shelves within the relatively rigid walls of a locker, precluding movement therein.

U.S. Pat. No. 4,537,451 issued on Aug. 27, 1985 to Theodore Bredderman et al., titled "Hanging Locker Shelves," describes a relatively narrow set of suspended shelves for use in a locker or the like. The Bredderman et al. shelves are suspended along opposite edges by flexible side panels, which in turn are suspended from a horizontal top shelf within the locker. Bredderman et al. do not provide for suspending their shelves from opposite coat hooks disposed upon the facing interior walls of the locker, due to the relative narrowness of their shelf assembly. Accordingly, the Bredderman et al. shelves cannot be wedged or otherwise immovably affixed between the opposite walls of the locker to prevent lateral movement of the shelves, as can the shelves of the present locker organizer invention. The Bredderman et al. shelving more closely resembles the shelves of the Berg '066 U.S. Pat. discussed further above, than it does the present invention.

U.S. Pat. No. 4,818,044 issued on Apr. 4, 1989 to Bradley M. Dobry, titled "Locker And Locker-Shelf Insert," describes a series of shelves supported by rigid metal rods, with the lower ends of the rods resting upon the floor of the locker. No overhead suspension system is disclosed by Dobry. The Dobry shelves take up only a portion of the width of the interior volume of the locker, and rely upon a lateral brace extending from the upper center support rod and bearing against the opposite locker wall to hold the shelves in place. It is noted that the use of only a single upper lateral brace would act as a lever which would tend to push the bottom of the shelf assembly away from the opposite wall of the locker, rotating about the fulcrum defined by the upper shelf. The wedge system of the present suspended shelf locker organizer results in a positive fit for each of the shelves without needing lateral rods extending across the interior of the locker, as in Dobry.

U.S. Pat. No. 4,858,772 issued on Aug. 22, 1989 to Theodore Phillipson, titled "Carousel Accessory Unit," describes a rotary shelf system having a series of vertical, peripheral rods between the circular shelves. The structure is rigid, as opposed to the flexible suspension ropes, cords, chains, or other components holding the shelves of the present locker organizer. No means of hanging or suspending the shelves or racks from an overlying structure, is disclosed by Dobry.

U.S. Pat. No. 5,154,500 issued on Oct. 13, 1992 to Yao-Shien Chang, titled "Collapsible Compartment-Forming Insert System For Storage Lockers," describes a series of rigid panels which are hinged together to fold in an accordion fashion. The panels are slightly wider than the internal width of the locker, which results in their wedging between the locker walls in a series of alternating sloped panels. Chang teaches away from the locker organizer of the present invention, due to the lack of any means to level the Chang panels within the locker.

U.S. Pat. No. 5,251,973 issued on Oct. 12, 1993 to Syd Hazan, titled "Locker Organizer Or The Like," describes a shelf assembly wherein the shelves lock to rigid support structures on each side, which rest upon the bottom of the locker. Hazan does not provide any means of hanging or suspending his shelves from overhead, nor does he provide any means of adjusting the height of his shelves or locking them securely between opposing interior walls of the locker.

U.S. Pat. No. 5,474,192 issued on Dec. 12, 1995 to Dane E. Hartzell, titled "Locker Shelf System," describes a wire frame which clips to the vent louvers on the inside of a locker door. Semicircular bins are removably placed in the frame. No overhead suspension of shelves is provided, nor is any means of immovably affixing such shelves between the walls of the locker provided by Hartzell.

U.S. Pat. No. 5,542,530 issued on Aug. 6, 1996 to Robert C. Freelander, titled "Suspended Adjustable Shelving For Garment Bag," describes a series of shelves suspended by cords, with locking of the position of the shelves along the cords being provided by a series of cord clamps. Two overhead hooks are provided at opposite sides of the assembly, for suspending the shelves from a closet hanger rod or the like. The Freelander shelves have an open grid structure, rather than being formed of solid sheet material, as in the case of the present locker organizer device. Moreover, Freelander teaches away from the means the present invention provides to secure the shelves immovably between opposite rigid locker walls, as Freelander is interested only in using his shelves within a flexible garment bag or the like. Finally, Freelander does not disclose any means of marking the suspension cords to indicate corresponding level marks for the shelves, as provided by the present invention.

U.S. Pat. No. 5,671,990 issued on Sep. 30, 1997 to Mark H. Teasdale, titled "Locker Shelf Apparatus," describes a single shelf which is suspended from three clothing hooks on the three corresponding walls within the interior of a locker. Only a single shelf, with optional pull-out drawer, is disclosed; no means of suspending further shelves below the single shelf is provided by Teasdale. The lack of corner suspension in the Teasdale shelf would permit the shelf to rock forward when the optional drawer was pulled out, particularly if there were any significant weight in the drawer and/or on the forward portion of the shelf. Teasdale does not disclose any means of securing his shelf immovably between the opposite walls of the locker, as provided by the present invention.

British Patent Publication No. 623,673 accepted on May 20, 1949 to Pinkus Flaum, titled "Improvements Relating To Display Stands For Garments," describes a pair of attachments which may be installed atop a conventional clothing rack. The attachments comprise vertical members with opposed arms extending essentially horizontally therefrom, for supporting a flexible cover or garment bag over the rack and any clothing hung therefrom. Neither the clothing rack nor the attachments disclosed in the '673 British Patent Publication, are adaptable for installation within a wall locker.

French Patent Publication No. 2,458,246 published on Jan. 2, 1981 to Jean Verdeau illustrates a set of shelves which are hingedly attached to a support structure at their rear edges. The shelves can be folded about their hinge axes, and are suspended at their front edges by ropes or the like. As the shelves of the French Patent Publication are hingedly attached to permanently fixed structure, there is no motivation to provide any means for securing the shelves laterally within a locker or the like, as provided by the present locker organizer invention.

European Patent Publication No. 385,607 published on Sep. 5, 1990 to the Stanley Works, titled "Modular Shelving And Hanger Bar System," describes a rigid framework shelf structure, wherein the shelves each comprise a series of lateral bars or channels which secure into correspondingly formed end supports. The end supports are in turn supported by the walls of the structure in which the modular shelving is installed, or by vertical members installed within the enclosure. The modular shelving of the '607 European Patent Publication is intended for use as a closet organizer, as all of the various shelves, hanger rods, etc., could not be assembled in a relatively narrow wall locker. Moreover, there is no disclosure in the '607 French Patent Publication of any means of hanging or suspending the shelves from an overlying structure.

European Patent Publication No. 543,063 published on May 26, 1993 to Acmetrack Ltd. (Kenneth Jacobs, inventor), titled "Shelving System," describes a shelving system much like that of the '607 European Patent Publication discussed immediately above. The system comprises a series of rigid components permanently secured to the interior walls of an enclosure, or to other structural members which are in turn secured to the walls of the closet. The same points of difference raised in the discussion of the '607 European Patent Publication, are seen to apply here as well.

Finally, World Patent Publication No. 94/27,474 published on Dec. 8, 1994 to the Stanley Works (Kenneth Jacobs, inventor), titled "Shelving System," describes a shelf assembly identical to that of the '063 European Patent Publication to the same inventor. The same points raised in the discussion of the '063 European Patent Publication, are seen to apply here as well.

None of the above inventions and patents, taken either singly or in combination, is seen to describe the instant invention as claimed. Thus a locker organizer solving the aforementioned problems is desired.

SUMMARY OF THE INVENTION

The present invention comprises various embodiments of a locker organizer having a series of suspended shelves which hang from the conventional coat hooks commonly found in such lockers. A problem with such suspended shelves in the past is that it has been difficult to fit them precisely within different makes and models of lockers; there are often differences of some fraction of an inch in internal dimensions, even with lockers having nominally the same external size. Suspended shelves will swing and bang against the interior of many lockers, if they are sufficiently small to fit the smallest dimensions commonly found in the various makes and models of lockers available.

Accordingly, the present invention includes a series of wedge devices secured to at least one of the edges of each shelf. The wedges fit adjustably between the corresponding edge of the shelf and the interior surface of the adjacent locker wall, to hold the shelf securely between the walls and preclude any movement of the shelf. The result is that a person may access the shelves and their contents, with the shelves remaining securely locked in place between the walls of the locker when articles are placed upon or removed from the shelves.

The shelves of the present invention are adjustably installed along their suspension lines (rope, cord, chain, etc.), to permit the user to adjust the height of the shelves within the locker as desired, depending upon the number of shelves, the height of the locker, the articles to be stored, etc. The suspension lines may include index markings to indicate the leveling of the shelves, if so desired. The shelves themselves may be formed of any suitable material, including plastic, metal, wood, etc., as desired.

Accordingly, it is a principal object of the invention to provide a locker organizer having one or more shelves suspended by a series of suspension lines from the conventional coat hooks disposed upon opposite walls of the locker.

It is another object of the invention to provide a locker organizer incorporating a series of wedges disposed along at least one edge of each shelf, for securing the shelves immovably between the walls of the locker in which the present invention is installed.

It is a further object of the invention to provide a locker organizer in which the shelf suspension lines include indexing indicator means to indicate that the shelves are level when aligned with the indicators.

Still another object of the invention is to provide a locker organizer in which the shelves comprise solid, unbroken sheets of material at least across their central areas, with the shelves being formed of metal, plastic, or wood, as desired, and the suspension lines being formed of cords, ropes, or chains, as desired.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention comprises a series of embodiments of a locker organizer, having one or more shelves (preferably plural shelves) suspended on flexible lines which hang from the conventional clothing or coat hooks provided in wall lockers. The present shelves each include means for wedging the shelves securely between opposite walls of the locker, to preclude banging or other movement of the shelves laterally within the locker when the contents are accessed.

Figure 1:
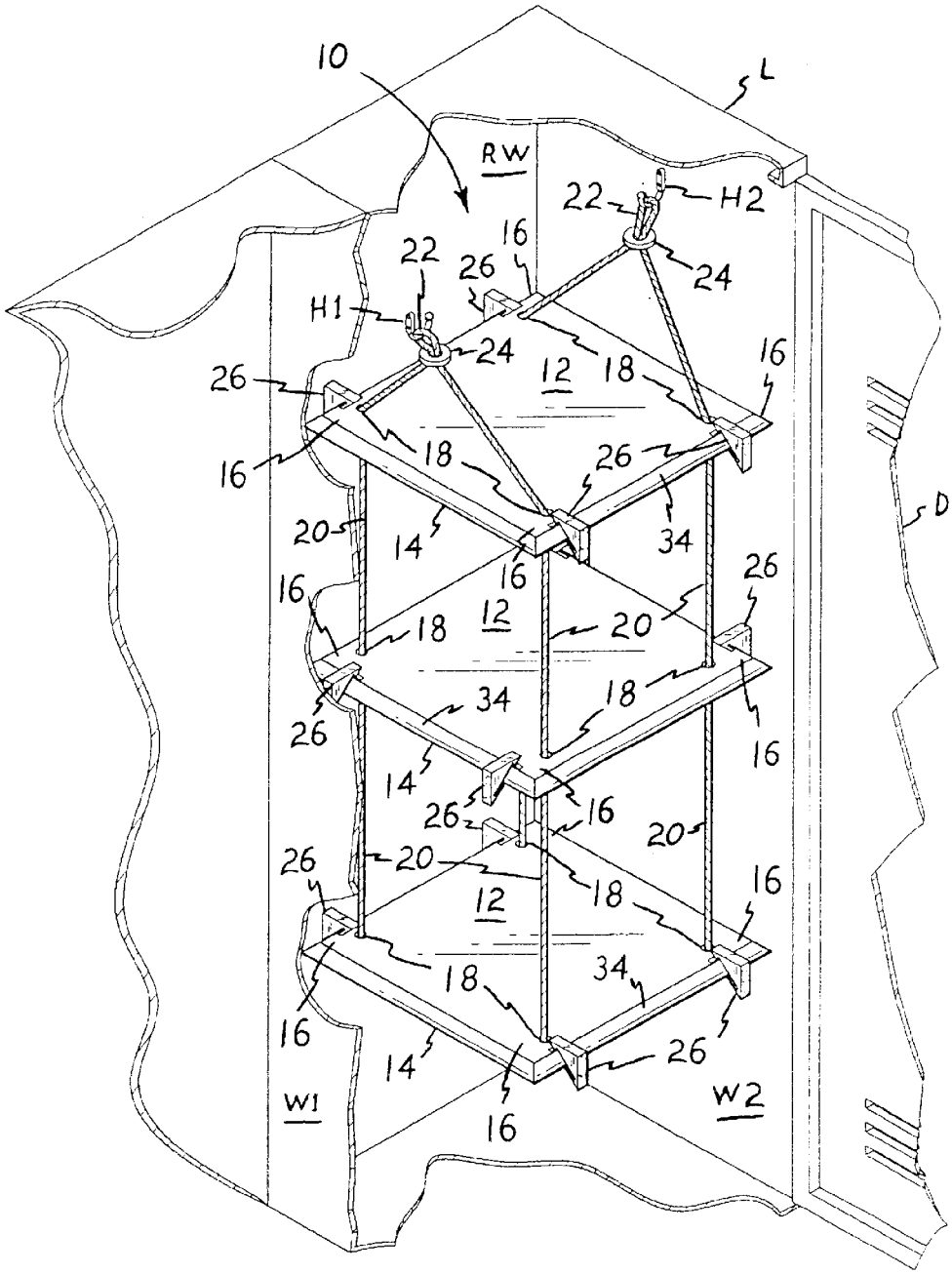
FIG. 1 is an environmental perspective view of a locker organizer according to the present invention, with the locker in which the organizer is installed being shown partially broken away.

FIG. 1 of the drawings provides an environmental perspective view of a first embodiment of the present locker organizer 10 installed within a conventional wall locker L, with the locker door D being shown in an open position and the left side or first wall W1 of the locker L being shown broken away in order to show the present locker organizer 10 clearly. The present locker organizer 10 preferably includes a series of rigid, flat, planar shelves 12, although the present locker organizer may comprise only a single shelf, if so desired. The shelves 12 may be constructed or formed of any suitable material, e.g., molded from plastic, stamped or otherwise formed of sheet metal or other metallic material, cut or otherwise formed from wood, etc., as desired. Each of the shelves 12 has a substantially rectangular periphery 14 and four corners 16. Each of the shelf corners 16 includes a suspension line passage 18 formed therethrough, with the four suspension line passages 18 each having a flexible shelf suspension line 20 passing therethrough. The suspension lines 20 may be formed of any suitable material, e.g., natural or synthetic rope, cord, or the like, monofilament plastic material, linked chain elements, etc., as desired. The arrangement of the suspension lines 20 through the corner passages 18 of the shelves 12, leaves a relatively large unbroken expanse of shelf area across each of the shelves 12, with no intervening structure to break up the usable space on each shelf 12.

The suspension lines 20 actually comprise two opposed pairs of lines, with each pair having an upper hanging loop 22 formed therein. The two opposed hanging loops 22 serve to removably suspend the suspension lines 20, and thus the shelves 12, from the conventional opposed clothing hanger hooks H1 and H2 conventionally provided upon the opposed first and second or left and right locker walls W1 and W2. A loop retainer 24 (e.g., washer, clamp, etc.) may be installed adjacent each hanging loop 22, to define the position of the loops 22 along the suspension lines 20.

At least one of the edges defining the shelf peripheries 14 includes a pair of lateral spacing adjustment wedges 26 adjustably secured thereto. The wedges 26 serve to lock the shelves 12 securely between the two lateral walls W1 and W2 (or between the rear wall RW and the edges of the conventional door frame, not shown, serving as the front wall) of the locker L. It will be noted in FIG. 1, that the upper and lower shelves 12 have their opposed adjustment wedges 26 oriented to lock against the rear wall RW and the opposed door frame of the locker L, while the center shelf 12 is turned to place the opposed wedges 26 against the opposite left and right locker walls W1 and W2. The orientation is not critical, and may be arranged to suit the user of the locker organizer 10, depending upon the configuration of the locker L and perhaps other factors. It will also be noted that the adjustment wedges 26 need only be provided along a single edge of each shelf 12 in some cases, depending upon the difference in dimensions between the shelf 12 and the locker interior.

Figure 2:
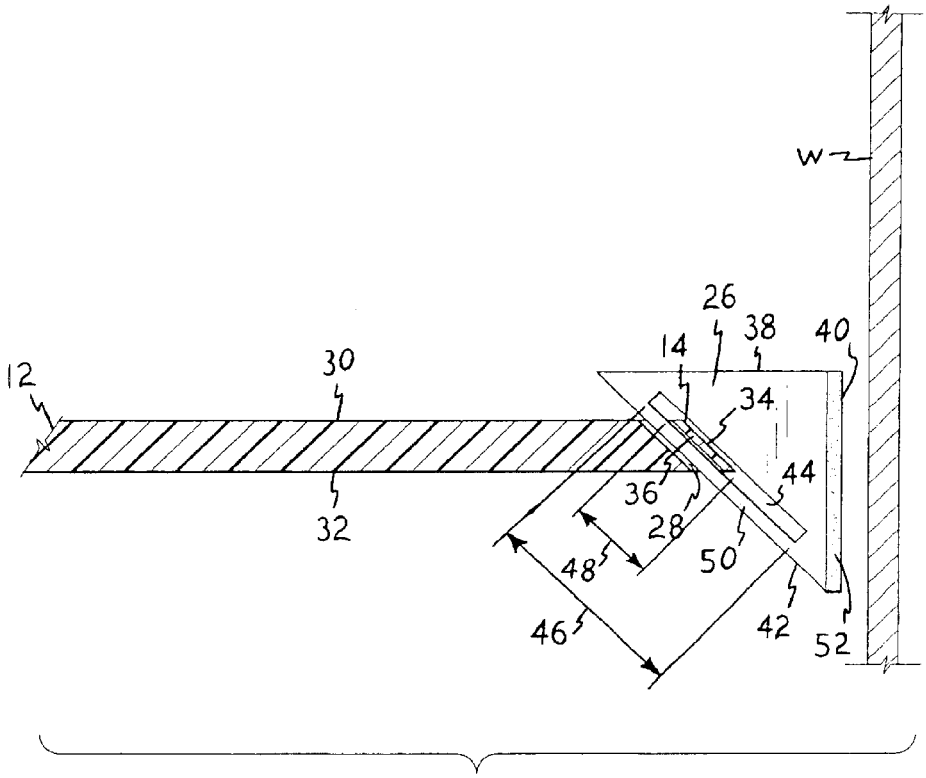
FIG. 2 is a detailed elevation view in section along line 2—2 of FIG. 3, showing details of the wedge component.
Figure 3:
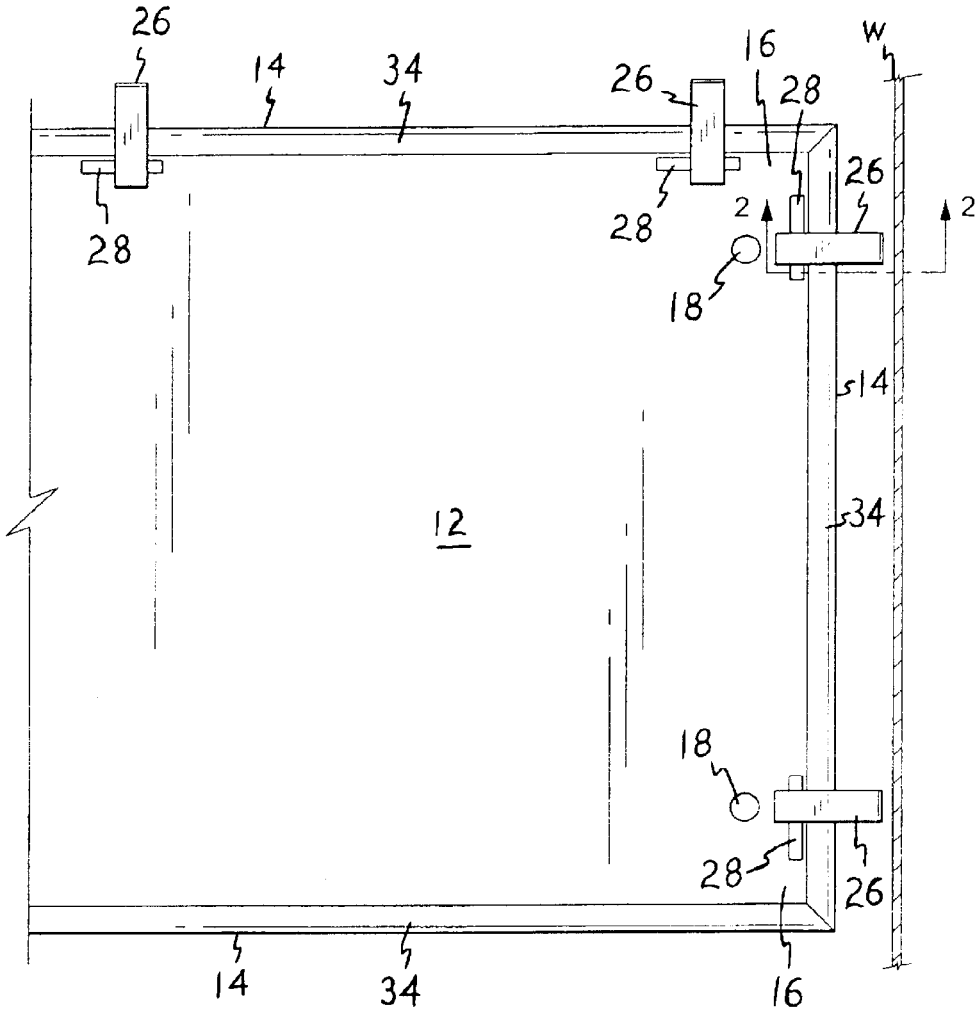
FIG. 3 is a top plan view of a portion of one shelf of the present locker organizer, showing the wedge and slot installation in the shelf and an adjacent locker wall in section.

FIG. 2 provides a detailed view of the installation of one of the lateral spacing adjustment wedges 26 along the periphery 14 of one of the shelves 12, as viewed from line 2—2 of FIG. 3. Each shelf 12 has a series of shelf slots 28 extending through the periphery 14 thereof, with at least two shelf slots 28 being formed along at least one of the straight edges of the periphery 14 of each shelf 12. The shelf slots 28 extend from the upper surface 30 of the shelf 12, in a downwardly and outwardly diagonal orientation through to the opposite lower surface 32. The peripheries 14 of the shelves 12 may have downwardly and outwardly beveled slopes 34 with faces parallel to the shelf slots 28, or at least that portion of the periphery 14 adjacent the shelf slots 28 may be beveled. This results in a diagonally downwardly and outwardly oriented wedge retaining member 36 between each of the shelf slots 28 and the corresponding beveled surface 34 of the shelf periphery 14, and spanning the shelf 12 between the upper and lower surfaces 30 and 32 thereof.

Each of the lateral spacing adjustment wedges 26 comprises a triangular block of material (plastic, wood, metal, etc.) having an upper face 38, a locker wall engaging face 40 essentially normal to the upper face 38, and a diagonal face 42 extending between the distal ends of the upper and locker wall engaging faces 38 and 40. A wedge slot 44 is formed through the wedge block 26, substantially parallel to the diagonal face 42 of the block 26. The wedge slot 44 has a length 46 substantially greater than the span 48 of the wedge retaining member 36 of the shelf 12, and defines an elongate shelf retaining member 50 between the wedge slot 44 and the diagonal face 42 of each lateral adjustment wedge 26. This construction captures the wedge retaining member 36 of the shelf 12 within the wedge slot 44 of the wedge 26, and allows each of the wedges 26 to slide outwardly and downwardly relative to the shelf 12 to which they are attached to wedge the locker wall engaging face 40 securely against the locker wall W. A pad 52 of relatively high friction material (e.g., rubber, etc.) may be provided on the locker wall engagement face 38, to provide a positive grip for the wedge 26 against the locker wall W.

FIG. 3 provides a top plan view of the locker organizer shelf 12 and lateral adjustment wedge 26 shown in detail in FIG. 2. A series of such wedges 26 is shown on two adjacent sides or edges of the shelf 12 of FIG. 3. It will be understood that such wedges would normally be installed only along one edge, or perhaps along two opposed edges, rather than along adjacent edges or on more than two opposed edges. However, such wedges 26 may be placed along one or more, or perhaps all, of the edges of the shelf 12 as desired, depending upon the number of shelf slots 28 provided along the periphery of the shelf 12. FIG. 3 also illustrates the location of two of the suspension line passages 18 which pass through or adjacent to the corners of the shelf 12, through which the suspension lines 20 are installed.

Figure 4:
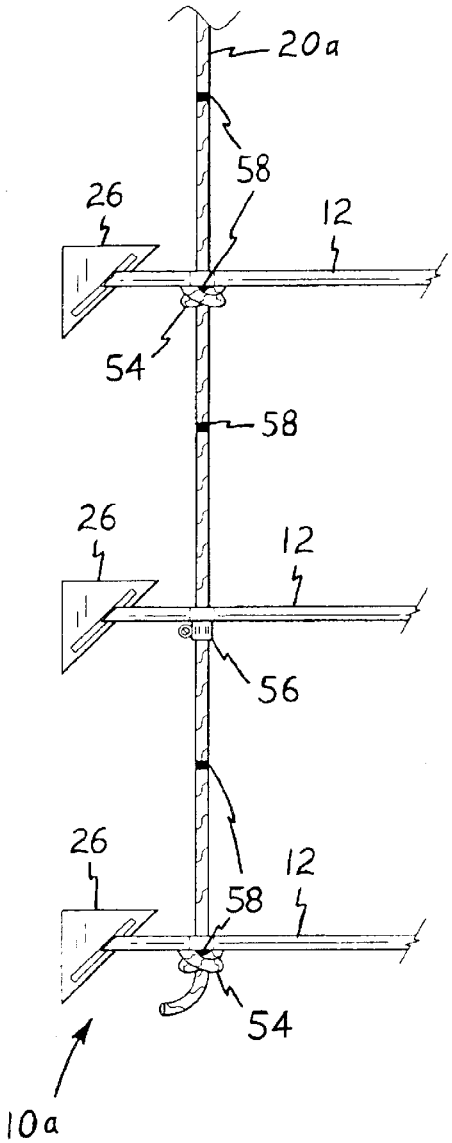
FIG. 4 is a side elevation view of a portion of one embodiment of the present locker organizer, showing a rope or cord suspension line for the shelves.

The present locker organizer may use ropes, cords, chains, plastic monofilament lines, etc. as suspension elements, as desired. FIG. 4 illustrates an embodiment 10*a* in which the shelves 12 are suspended by multiple strand twisted, braided, or woven rope or cord suspension lines 20*a*, with a single exemplary line 20*a* being shown in FIG. 4. Each of the shelves 12 is supported by a shelf support stop immediately therebelow, upon which the shelves 12 rest along the suspension lines 20. The shelf support stops formed along the shelf suspension line 20*a* shown in FIG. 4 may comprise knots 54 tied along the length of the suspension lines, clamps 56 secured about the lines, or other positive shelf supporting means positioned along the suspension line 20*a* as desired.

It may be helpful to some users of the present invention, to provide shelf leveling indicators along the shelf suspension lines to indicate the proper positions for the shelf support stops thereon. FIG. 4 illustrates a series of such shelf leveling indicators 58, comprising stripes of contrasting color disposed about the shelf suspension rope or cord 20*a*. (Some of these indicators 58 are only partially visible within the shelf support knots 54, in FIG. 4.) A person assembling and adjusting the locker organizer 10*a* of FIG. 4, need only assure that the two lines comprising the corresponding line pair extend downwardly evenly from their hanging loop, and tie the knots 54 or adjust the clamps 56 at the desired shelf level indicator marks 58 to be assured that the corresponding shelves 12 will remain level. Stripes of contrasting color, lettered or numbered marks or indicators, filaments of contrasting color(s) woven into the rope or cord, etc., may be used to form the shelf leveling indicators 58 of the present invention. Obviously, a person assembling the present locker organizer may position the knots 54, clamps 56, or other shelf stop means at locations along the rope or cord other than at the level indicator marks 58, if so desired.

Figure 5:
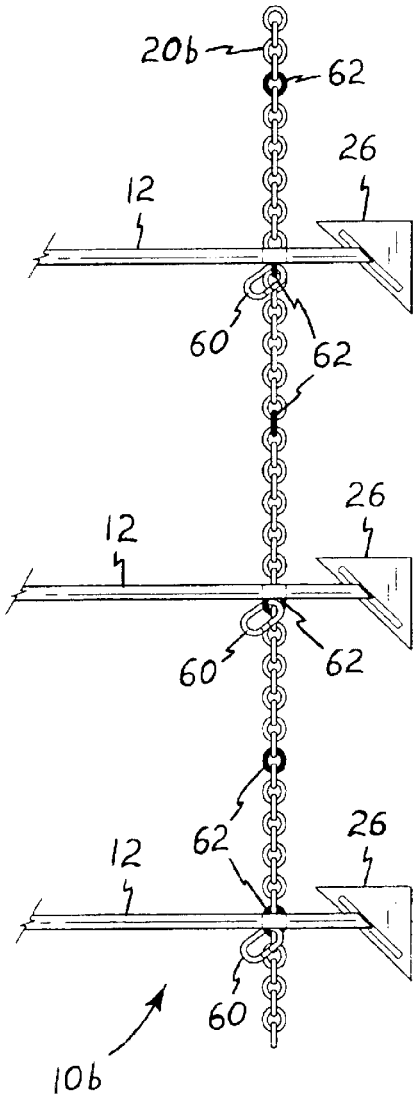
FIG. 5 is a side elevation view of a portion of another embodiment of the present locker organizer, showing a chain suspension line for the shelves.

FIG. 5 illustrates a broken away portion of another embodiment of the present locker organizer, designated as locker organizer lob. Locker organizer lob differs from the other embodiments in that the shelf support lines 20*b* supporting the shelves 12, comprise chains formed of a series of individual links. Where shelf support chains 20*b* are used, the shelf support stops may comprise snap links 60, clips, carabiners, or other mechanical devices which can be removably clipped or linked to any of the chain links as desired. The shelves 12 then rest upon the shelf support stop links 60, which extend from the selected chain links.

As in the case of the shelf suspension rope or cord 20*a* of FIG. 4, the shelf suspension chain 20*b* of FIG. 5 may include some form of shelf leveling indicator means thereon. In FIG. 5, the shelf leveling indicators comprise colored chain links 62, which are spaced along the length of the chain 20*b* at predetermined intervals. The level indicator links 62 may be marked in some other manner, e.g., alphanumeric coding, different shapes (rectangular rather than round links for the majority of the chain), tags extending from the designated links, etc., as desired. A person assembling the locker organizer lob of FIG. 5 indeed only equalize the lengths of the two chains forming the chain pair which is suspended from one of the hooks in the locker, and clip or otherwise secure the snap links, clips, or other shelf support stops 60 through the desired level indicator links 62, as desired. As in the case of the rope or cord shelf suspension embodiment of FIG. 4, a person assembling the locker organizer embodiment of FIG. 5 may locate the shelf support stops 60 at positions along the chain 20*b* other than at the marked links 62, if so desired.

In conclusion, the present locker organizer in its various embodiments is a highly desirable and versatile accessory for students, athletic club members, sports enthusiasts, and others who have occasion to use a relatively tall and narrow wall locker. The present locker organizer is particularly useful to those who have a specific locker assigned to them for an extended period of time. However, the present locker organizer may be quickly and easily removed and transferred between different lockers having similar configurations, as necessary. While the present locker organizer is particularly useful for persons having a number of relatively small or short articles (e.g., books, folded clothing, shoes, etc.) requiring storage, it may be adjusted as necessary to provide additional space for larger articles. The user need only remove unneeded shelves, or adjust the positions of the unneeded shelves so they lie adjacent one another, to provide additional space between shelves.

One or more of the shelves may be provided, with clothing support hooks extending therebelow to take the place of the permanently installed hooks of the wall locker, from which the suspension lines of the present locker organizer are hung. A person using the present locker organizer may thus adjust the spacing between shelves to accommodate relatively long articles (coats, etc.) and hang those articles from the hook(s) extending below one of the shelves of the present locker organizer, if so desired. Accordingly, the versatility and utility of the present locker organizer, with its inexpensive construction, ease of installation, removal, and adjustment, and means for securing laterally within the locker to preclude lateral movement and banging against the interior of the locker when articles are placed upon or removed from the shelves, provides a most desirable accessory for anyone who has occasion to use a wall locker or similar storage unit.

It is to be understood that the present invention is not limited to the embodiments described above, but encompasses any and all embodiments within the scope of the following claims.

I claim:

1. A locker organizer, comprising:

at least one flat, planar shelf having a generally rectangular periphery defining four corners, each of the four corners having a suspension line passage formed therethrough, said shelf having a plurality of shelf slots defined through said periphery;

four flexible shelf suspension lines, each of the shelf suspension lines extending through a corresponding one of the corners, the four suspension lines being disposed in opposing pairs;

a shelf support stop disposed upon each of the shelf suspension lines, immediately below a corresponding said shelf;

a pair of upper hanging loops, each of the loops being formed in one of the opposing pairs of suspension lines, respectively; and at least one lateral spacing adjustment wedge movably secured through each of said shelf slots.

2. The locker organizer according to claim 1, wherein:

said at least one shelf comprises a plurality of shelves;

each of said shelves further includes an unbroken central area; and each of said shelves is formed of materials selected from the group consisting of plastic, metal, and wood.

3. The locker organizer according to claim 1, wherein:

said at least one shelf has an upper surface and a lower surface;

each of said shelfslots extends through said at least one shelf from said upper surface to said lower surface, in a downward and outward diagonal orientation;

the periphery of said at least one shelf has a beveled slope substantially parallel to said diagonal orientation of said shelf slots;

the beveled slope of the periphery and each of said shelf slots define a corresponding diagonally sloped wedge retaining member therebetween;

each of said wedge retaining members having a diagonal span extending from said upper surface to said lower surface of said at least one shelf;

each of said wedges comprising a triangular block having an upper face, an engaging face substantially normal to said at least one shelf, and a diagonal face;

each of said wedges further including a wedge slot formed therethrough, substantially parallel to said diagonal face;

said wedge slot and said diagonal face of each of said wedges defining a diagonally sloped shelf retaining member therebetween;

said wedge slot having a length substantially greater than said span of said wedge retaining member of said shelf; and said shelf retaining member of said wedge passing through a corresponding one of said shelf slots and secured to said at least one shelf by said wedge retaining member of said at least one shelf passing through said wedge slot, with said wedge being slidably movable diagonally relative to said at least one shelf for wedging said shelf immovably against an adjacent surface.

4. The locker organizer according to claim 1, wherein said shelf suspension lines are selected from the group consisting of cords, ropes, and chains.

5. The locker organizer according to claim 1, wherein:

said shelf suspension lines are selected from the group consisting of cords and ropes; and said shelf support stops comprise knots formed along said shelf suspension lines as desired.

6. The locker organizer according to claim 1, wherein:

said shelf suspension lines comprise chains formed of a plurality of chain links; and said shelf support stops comprise clips selectively installed through said chain links as desired.

7. The locker organizer according to claim 1, further including at least one shelf leveling indicator disposed upon each of said shelf suspension lines.

8. A locker organizer comprising:

at least one flat, planar shelf having a generally rectangular periphery defining four corners, each of the four corners having a suspension line passage defined therethrough, four flexible shelf suspension lines, each of the shelf suspension lines extending through a corresponding one of the corners, the shelf suspension lines being disposed in opposing pairs, said shelf suspension lines being selected from the group consisting of cords and ropes;

a shelf support stop disposed upon each of the shelf suspension lines, immediately below a corresponding said shelf, said shelf support stops comprise of knots formed along said shelf suspension lines;

a pair of upper hanging loops, one of the loops being formed in one of the opposing pairs of shelf suspension lines, respectively;

at least one shelf leveling indicator disposed upon each of the shelf suspension lines; and wherein, at least one lateral spacing adjustment wedge movably secured through each of a plurality of shelf slots.

9. The locker organizer according to claim 8, wherein:

said at least one shelf comprises a plurality of shelves;

each of said shelves further includes an unbroken central area; and each of said shelves is formed of materials selected from the group consisting of plastic, metal, and wood.

10. The locker organizer according to claim 8, wherein:

said at least one shelf further includes an upper surface and a lower surface, with said plurality of shelf slots extending through said periphery of said at least one shelf;

each of said shelf slots extends through said at least one shelf from said upper surface to said lower surface, in a downward and outward diagonal orientation;

said periphery of said at least one shelf has a beveled slope substantially parallel to said diagonal orientation of said shelf slots;

said beveled slope of said periphery and each of said shelf slots define a corresponding diagonally sloped wedge retaining member therebetween;

each of said wedge retaining members has a diagonal span extending from said upper surface to said lower surface of said at least one shelf;

each of said wedges comprises a triangular block having an upper face, an engaging face substantially normal to said at least one shelf, and a diagonal face;

each of said wedges further includes a wedge slot formed therethrough, substantially parallel to said diagonal face;

said wedge slot and said diagonal face of each of said wedges defining a diagonally sloped shelf retaining member therebetween;

said wedge slot has a length substantially greater than said span of said wedge retaining member of said shelf; and said shelf retaining member of said wedge passes through a corresponding one of said shelfslots and is secured to said at least one shelf by said wedge retaining member of said at least one shelf passing through said wedge slot, with said wedge being slidably movable diagonally relative to said at least one shelf for wedging said shelf immovably against an adjacent surface.

11. A wall locker in combination with a locker organizer, comprising:

the wall locker having opposed left and right lateral walls, a rear wall, and a front wall having a door disposed within said front wall;

a clothing hanger hook extending inwardly from each of said lateral walls of said wall locker;

the locker organizer having at least one flat, planar shelf with a generally rectangular periphery and four corners;

each of said four corners of said at least one shelf of said locker organizer having a suspension line passage therethrough;

four flexible shelf suspension lines, with each of said shelf suspension lines extending through a corresponding one of said corners of said at least one shelf of said locker organizer;

a shelf support stop disposed upon each of said shelf suspension lines, immediately below a corresponding said shelf of said locker organizer;

said shelf suspension lines comprising opposed pairs of shelf suspension lines, with each of said pairs forming an upper hanging loop therein;

each of said hanging loops of said suspension lines of said locker organizer being removably installed over a corresponding said hanger hook of said wall locker, for suspending said locker organizer within said wall locker;

at least one shelf leveling indicator disposed upon each of said shelf suspension lines;

said at least one shelf of said locker organizer further including a plurality of shelf slots through said periphery thereof; and a lateral spacing adjustment wedge movably secured through each of said shelfslots of said shelf of said locker organizer.

12. The wall locker and locker organizer combination according to claim 11, wherein:

said at least one shelf of said locker organizer further includes an upper surface and a lower surface;

each of said shelf slots of said at least one shelf of said locker organizer extends through said at least one shelf from said upper surface to said lower surface thereof, in a downward and outward diagonal orientation;

said periphery of said at least one shelf of said locker organizer has a beveled slope substantially parallel to said diagonal orientation of said shelf slots;

said beveled slope of said periphery and each of said shelf slots define a corresponding diagonally sloped wedge retaining member therebetween;

each of said wedge retaining members having a diagonal span extending from said upper surface to said lower surface of said at least one shelf;

each of said wedges of said locker organizer comprising a triangular block having an upper face, an engaging face substantially normal to said at least one shelf, and a diagonal face;

each of said wedges of said locker organizer further including a wedge slot formed therethrough, substantially parallel to said diagonal face;

said wedge slot and said diagonal face of each of said wedges of said locker organizer defining a diagonally sloped shelf retaining member therebetween;

said wedge slot having a length substantially greater than said span of said wedge retaining member of said shelf of said locker organizer; and said shelf retaining member of said wedge passing through a corresponding one of said shelf slots and secured to said at least one shelf by said wedge retaining member of said at least one shelf passing through said wedge slot, with said wedge being slidably movable diagonally relative to said at least one shelf for wedging said shelf immovably against at least two opposed said walls of said wall locker.

13. The wall locker and locker organizer combination according to claim 11, wherein:

said at least one shelf of said locker organizer comprises a plurality of shelves;

each of said shelves of said locker organizer further includes an unbroken central area; and each of said shelves of said locker organizer is formed of materials selected from the group consisting of plastic, metal, and wood.

14. The wall locker and locker organizer combination according to claim 11, wherein said shelf suspension lines of said locker organizer are selected from the group consisting of cords, ropes, and chains.

15. The wall locker and locker organizer combination according to claim 11, wherein:

said shelf suspension lines of said locker organizer are selected from the group consisting of cords and ropes; and said shelf support stops comprise knots formed along said shelf suspension lines of said locker organizer as desired.

16. The wall locker and locker organizer combination according to claim 11, wherein:

said shelf suspension lines of said locker organizer comprise chains formed of a plurality of chain links; and said shelf support stops comprise clips selectively installed through said chain links as desired.

* * * * *